US005163645A

United States Patent [19]

Caruso

[11] Patent Number: 5,163,645

[45] Date of Patent: Nov. 17, 1992

[54] BAG HOLDER

[76] Inventor: Steve Caruso, 18 Gatsby Square, Bramalea, Ontario, L6S 2H4, Canada

[21] Appl. No.: 747,904

[22] Filed: Aug. 19, 1991

[51] Int. Cl.[5] ..... B65B 67/00

[52] U.S. Cl. ..... 248/99; 383/23

[58] Field of Search ..... 248/95, 97, 98, 99, 248/100, 101; 383/23

[56] References Cited

U.S. PATENT DOCUMENTS

| | | | |
|---|---|---|---|
| 313,515 | 3/1885 | Parker | 248/99 |
| 575,403 | 1/1897 | Morton | 248/100 |
| 960,451 | 6/1910 | Vicary | 248/99 |
| 1,426,528 | 8/1922 | White | 248/99 |
| 1,427,123 | 8/1922 | Pulig | 248/99 |
| 3,257,090 | 6/1966 | Frazier | 248/99 |
| 4,723,695 | 2/1988 | Farber | 248/95 X |

FOREIGN PATENT DOCUMENTS

| | | | |
|---|---|---|---|
| 1262956 | 2/1972 | United Kingdom | 248/99 |

*Primary Examiner*—David L. Talbott

[57] ABSTRACT

The present invention provides a bag holder to receive a bag looped over the holder. The holder comprises a forward arm, a rearward arm spaced from and connected at one end to the forward arm and a support surface mount. The forward arm has a free end and is clear along its length up to the other end connection with the rearward arm whereby the forward arm provides an extended support surface over which the bag is looped onto the bracket.

6 Claims, 2 Drawing Sheets

BAG HOLDER

FIELD OF THE INVENTION

The present invention relates to a bag holder over which a bag is looped.

BACKGROUND OF THE INVENTION

Over the last few years there has been a big push for the recycling of different items such as plastic, glass and even metal type containers. In fact, very recently special outdoor boxes have been built into which these types of containers are loaded and to be picked up on specific days of the week for recycling purposes. However, most people don't have the time on every occasion to load a recyclable container into these outdoor boxes and therefore, many recyclable containers are simply thrown into a garbage bag. Typically, these garbage bags are mounted in a square like frame on the inside of a kitchen cupboard door with the upper edges of the garbage bag being folded down over the frame. Often times the weight in the bag will pull it completely off of the frame since there is no positive interlock between the bag and the frame.

SUMMARY OF THE PRESENT INVENTION

The present invention provides a bag holder specifically designed to loop a bag over the holder thereby providing a positive engagement between the holder and the bag. The bag which may be used for many different purposes has particular utility as either a garbage bag or a storage bag for recyclable products.

The bag holder of the present invention comprises a forward arm and a rearward arm spaced from and having a connection to one another at one end only of the holder. Accordingly, the forward arm has a free end and is completely clear along its length up to the connection with the rearward arm. The forward arm therefore provides an extended support over which the bag, such as a standard handle grocery bag, can be looped. In the alternative, a special bag having a continuous looped upper edge and made in accordance with the preferred embodiment of the invention can be slid onto the forward arm of the holder.

The rearward arm of the holder is provided with means for mounting the holder to a supporting surface. Again, in accordance with a preferred embodiment of the present invention, this means comprises a vertical member slideable into a mounting bracket for receiving the vertical member of the holder. The vertical member doubles as a handle for gripping the bag holder when not supported by the mounting bracket.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
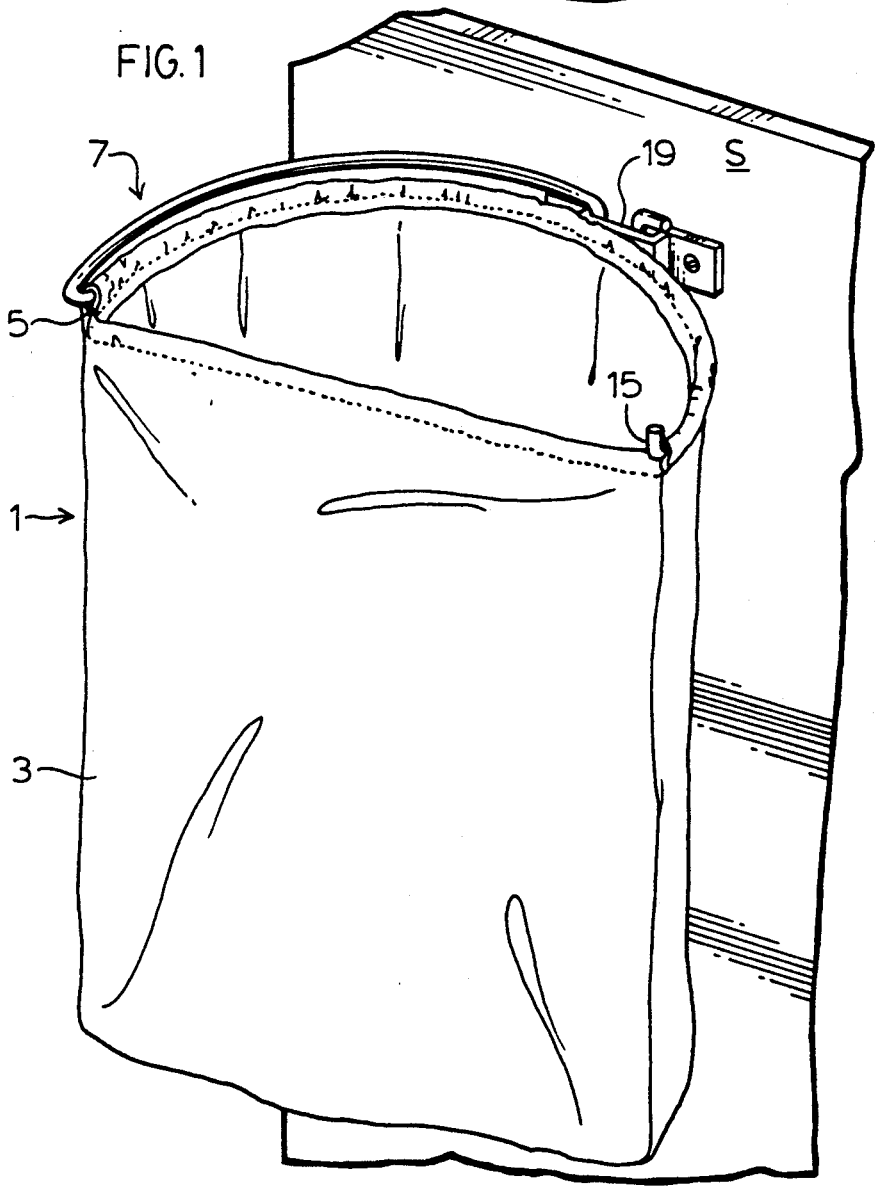
FIG. 1 is a perspective view of a bag system including a bag holder and a bag mounted to that holder made in accordance with a preferred embodiment of the present invention.
Figure 3:
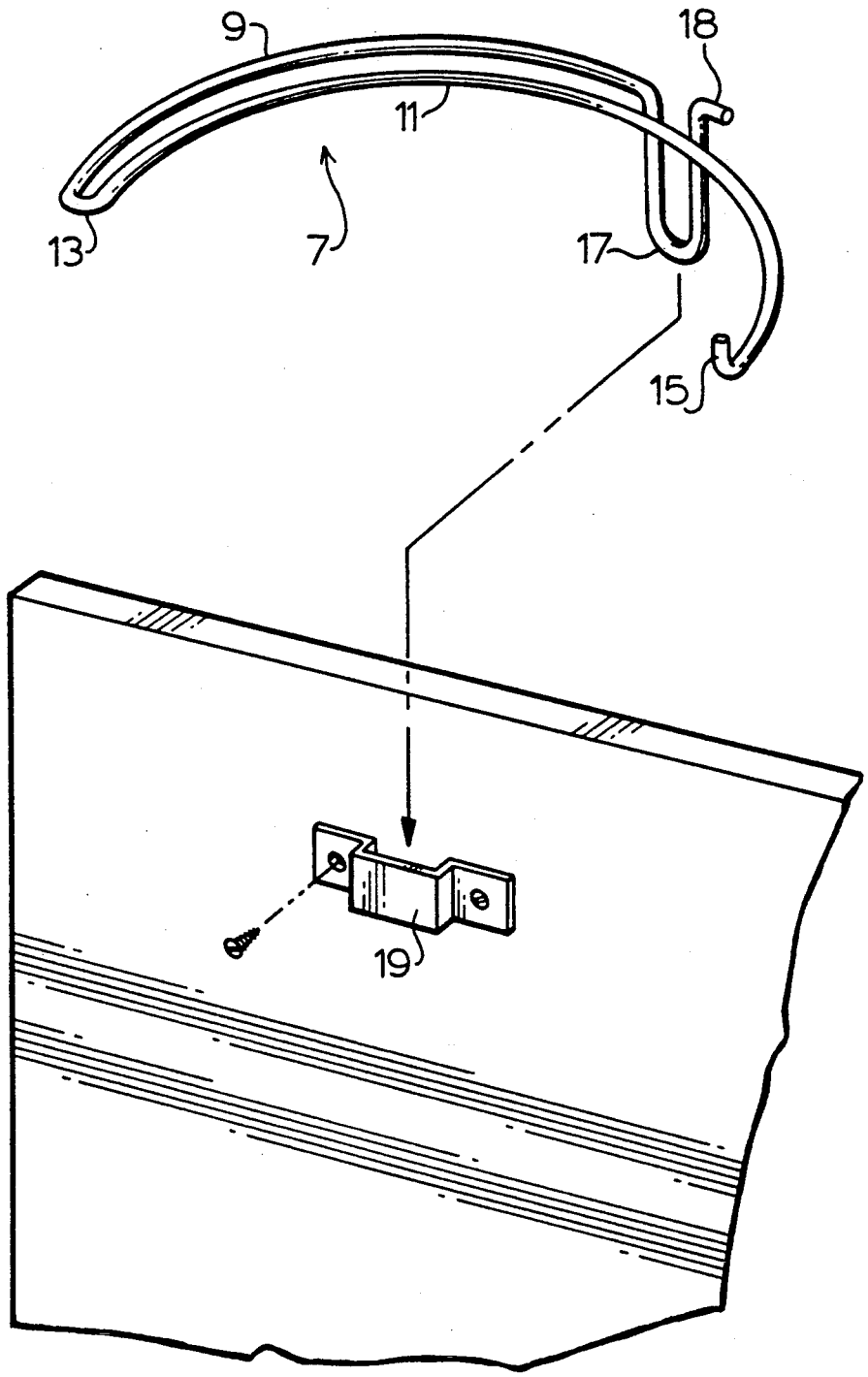
FIG. 3 is a view similar to FIG. 2 with the holder removed from the mounting bracket.

FIG. 1 shows a bag and bag holder combination generally indicated at 1. This particular combination is designed for the storage of recyclable containers with the bag being removable from the holder to dump those recyclable contains into an outdoor recycling box.

In particular, the set up of FIG. 1 comprises a bag 3 which is specifically made with a rear upper edge in the form of a continuous loop 5 along the back of the bag. This loop 5 of the bag is fitted over a holder for the bag and generally indicated at 7. A mounting bracket 19 is also provided for mounting the bag holder to a supporting surface S such as a cupboard door or any other similar flat surface used to receive the holder.

Bag 3 is also shown as being looped along its upper front edge with both the front and back loops allowing for the fitting of a drawstring to close the upper end of bag 3.

Figure 2:
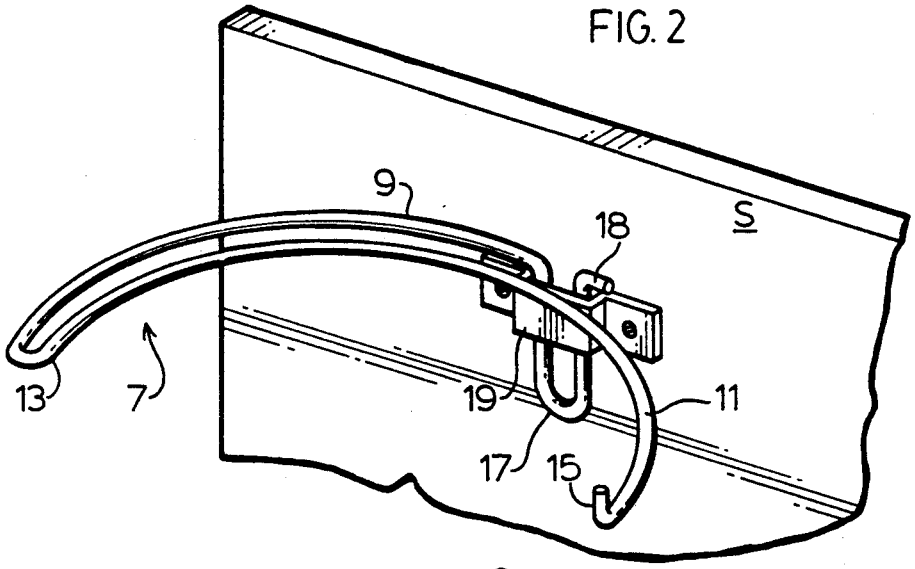
FIG. 2 is an perspective view of the bag holder used in FIG. 1 with the bag removed from the holder.

The details of the holder 7 itself are best seen in FIG. 2 of the drawings. In particular, the holder which has a thick wire or wire-like construction comprises a forward arm 11 and a rearward arm 9. These two arms are connected at 13 to one another at one side only of the holder. The holder is made by bending the wire or wire-like frame so that the arms reverse in direction extending generally parallel to and slightly spaced from one another with the rearward arm 9 being about half the length of the forward arm 11. The rearward arm 9 terminates in a downwardly extending member 17 positioned behind and about mid way along the length of the forward arm. The proportions and positioning of the forward and rearward arms provide a balanced load receiving region on the holder even though the forward arm is longer than the rearward arm because of the mid positioning support of member 17. As can be seen in FIG. 2 member 17 is made by bending the wire holder downwardly and then bending it back upwardly to provide a wide flat configuration to fit into bracket 19 which is provided with openings for receiving screws or the like to mount the bracket to the supporting surface. The widened shape of member 17 prevents rotation of the member in the bracket 19. The entire holder 7 is easily removed from bracket 19 by simply lifting the member 17 out of the bracket. The vertical member 17 can then be used as a grip or carrying handle for the holder. Note that the free end 18 of the vertical member or handle 17 is bent in a short horizontal section parallel to arm 9 so that the vertical member is supported at both sides along the upper edge of bracket 19 to prevent tipping of the holder in the bracket.

One of the key features of the present invention is that the forward arm 11 of the holder is completely free along its length to enable the looping of bag 3 onto the forward arm over its free end 15. Also note in the preferred embodiment of the present invention that free end 15 of the forward arm has a slight upward turn providing a positive seat for the loop 5 of bag 3.

Although the drawings show a specific bag designed for the holder of the present invention, it is to be appreciated that other types of bags such as a standard handle provided grocery bag can easily be looped over the forward arm of the holder.

It is also to be noted that the forward arm 11 of the holder has a rearward concave configuration which is particularly suitable for use with bag 3 in that it provides an automatic opening of the bag as shown in FIG. 1 when looped over the holder.

Although various preferred embodiments of the present invention have been described in detail, it will be appreciated that variants may be made without departing from the spirit of the invention or the scope of the appended claims.

The embodiments of the invention in which an exclusive property or privilege is claimed are defined as follows:

1. A bag and bag holder combination, said bag holder comprising a first forward arm with a free end and a second end connected to a second rearward arm behind and supporting said first arm, said forward arm being curved rearwardly between said first and second ends thereof, said bag having a mouth defined by forward and rearward top edges of said bag, said rearward top edge being looped over said forward arm of said bag holder and said forward top edge of said bag being stretched across said first and second ends of said forward arm with said rearward top edge being spread away from said forward top edge of said bag by said forward arm of said bag holder thereby producing an opening of the bag mouth.

2. A bag and bag holder combination as claimed in claim 1 wherein said bag includes a continuous loop along said rearward top edge, said loop being open at opposite ends thereof and said loop being fed completely onto said forward arm of said bag holder, said free end of said forward arm being turned in a direction out of line with said forward arm and wherein said connected end of said forward arm reverses in direction from said forward arm thereby trapping said loop between said free and said connected end of said forward arm.

3. A bag and bag holder combination as claimed in claim 1 wherein said forward arm of said bag holder has a concave curvature and wherein said rearward arm is parallel to and spaced slightly behind said forward arm, said rearward arm terminating with a downward extension behind and midway of said forward arm.

4. A bag and bag holder combination as claimed in claim 3 wherein said downward extension comprises a U-shaped extension of said rearward arm fitted within a mounting bracket supporting said bag holder, said U-shaped extension comprising a handle balanced centrally of said bag holder.

5. A bag and bag holder combination as claimed in claim 1 wherein said bag is held only by said first arm and only along the rearward top edge thereof without looping onto said second arm of said bag holder.

6. A bag and bag holder combination as claimed in claim 1 wherein said bag is unsupported and free of said bag holder along said forward top edge of said bag.

* * * * *